United States Patent [19]

Eubanks et al.

[11] 4,161,075

[45] Jul. 17, 1979

[54] THREAD AND YARN ORGANIZER

[76] Inventors: Ann S. Eubanks, 6737 Moss Lake Dr., Chattanooga, Tenn. 37343; Celeste M. Steinkraus, 204 E. Lake Shore Ter., Chattanooga, Tenn. 37415

[21] Appl. No.: 879,664

[22] Filed: Feb. 21, 1978

[51] Int. Cl.[2] ..... B65H 75/06; B65H 75/28; G09F 3/08

[52] U.S. Cl. ..... 40/309; 206/388; 223/106; 242/85.1; 242/125.1

[58] Field of Search ..... 242/125.1, 125.2, 125, 242/125.3, 85.1, 222; 223/106; 40/309, 21 R, 10 R, 10 A, 305; 206/388, 49

[56] References Cited

U.S. PATENT DOCUMENTS

| | | | |
|---|---|---|---|
| 506,130 | 10/1893 | Perkins | 242/68 |
| 1,682,631 | 8/1928 | Sayler | 242/85.1 |
| 1,732,928 | 10/1929 | Clark | 40/21 R |
| 2,422,358 | 6/1947 | Lobl et al. | 242/85.1 |

*Primary Examiner*—George F. Mautz
*Attorney, Agent, or Firm*—Dowell & Dowell

[57] ABSTRACT

Substantially flat modified hourglass shaped holders around which yarn may be wound, and having slits at one end for retaining the ends of the yarn, an aperture at the other end for suspending the device from a support, and a sleeve holder intermediate the two ends for identification indicia, may be used in multiple for organizing and storing yarn of varying colors and shades.

3 Claims, 5 Drawing Figures

THREAD AND YARN ORGANIZER

BACKGROUND OF THE INVENTION

1. Field of the Invention

This invention relates to a device for organizing and holding in position for convenient examination, access and use one or more strands of yarn, or the like, of indeterminate length, in order that the user may store in a manner for expeditious selection and retrieval of a large number of strands or lengths of thread and yarn, which differ in color and color gradations.

2. Description of the Prior Art

Various devices including packages, cards and bobbins have been known heretofore which are provided for the purpose of wrapping lengths or strands of yarn and thread thereon in order that the same may be stored in an organized fashion and retrieved as desired.

Thus, in the patent to Linnell, U.S. Pat. No. 933,189, a sheet member is disclosed having notches at the ends around which shoe laces are wrapped.

Grote, U.S. Pat. No. 1,388,561, discloses a display card having a tongue at one end around which the loop of a length of yarn may be wrapped and having other tongues spaced therefrom for holding the ends of the yarn.

Sharp, U.S. Pat. No. 2,016,181, discloses a sheet member having a plurality of slits or indentations along its sides around which lengths of yarn may be wrapped.

Gomberg, U.S. Pat. No. 2,371,756, discloses a yarn bobbin of sheet material around which yarn may be wrapped.

Lobl, U.S. Pat. No. 2,422,358, discloses a yarn bobbin of sheet material shaped like a dumbbell and having slits at each end for receiving the ends of yarn which are wrapped around the body of the bobbin.

York, U.S. Pat. No. 2,646,196, discloses a sheet member yarn holder having apertures through which the yarn is placed.

SUMMARY OF THE INVENTION

The storage and retention for convenient examination and use of one or more lengths or strands of yarns presents a problem which has not been adequately met heretofore. In fancy needlework such as embroidery, needlepoint, crewel and the like, the user may desire to selectively use and store a large number of skeins, or lengths, of yarn or thread without the threads becoming entangled. These may differ in both major and minor color variations and textures. Thus, it becomes desirable to be able visually to examine the yarn but also specific written identification indicia associated with each skein which facilitates selection of the desired length of material.

The present invention is embodied in a holder for each skein or strand of yarn, the holder having provision for wrapping the strand thereon and securing its ends, for mounting identification indicia, such as the sleeve ordinarily disposed about the skeins, on the holder for identification purposes, and an aperture for mounting the holder on a rod or ring member, if desired. The configuration of the holders also is such as to facilitate storing a substantial number in closely confined relationship within a receptacle without presenting undue problems of interference between the individual members. Thus, groups of skeins may be stored and be readily identifiable in order that a desired skein may be located, selected and removed from a group of skeins so that a desired length of thread or yarn may be removed therefrom while the remainder of the yarn is retained on the holder.

DESCRIPTION OF THE PREFERRED EMBODIMENT

Figure 1:
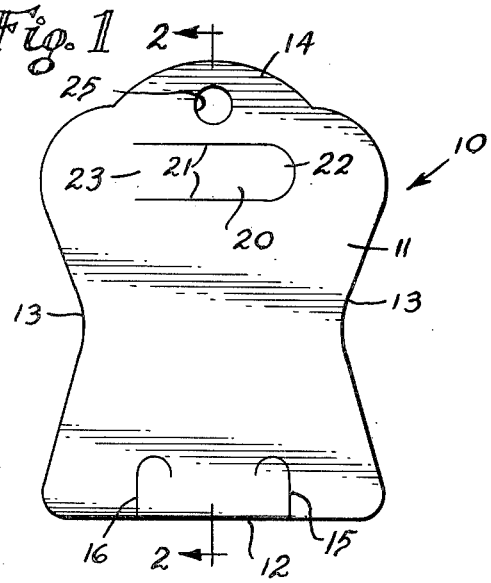
FIG. 1 is a plan view of a preferred embodiment of the invention.
Figure 2:
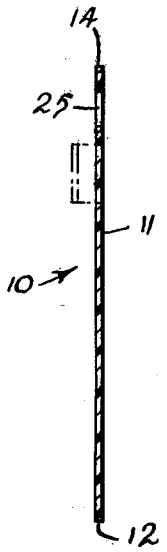
FIG. 2 is a sectional view taken on the line 2—2 of FIG. 1.
Figure 3:
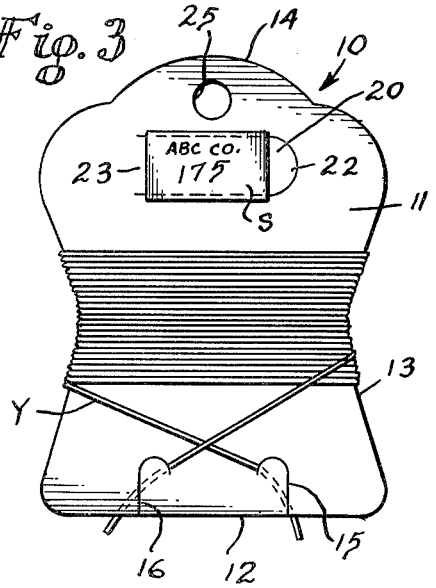
FIG. 3 is a plan view illustrating the device in use.
Figure 4:
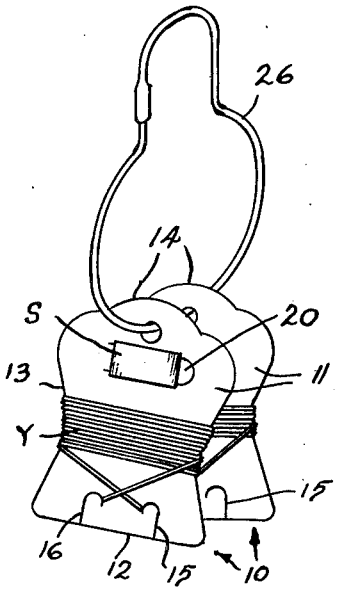
FIG. 4 is a representative assemblage of holders mounted on a hook-type support.
Figure 5:
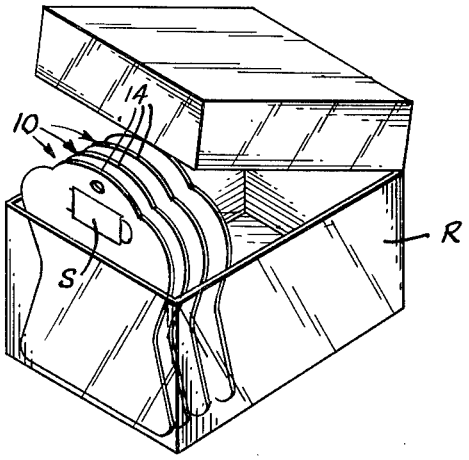
FIG. 5 is a representative assemblage of holders stored in a receptacle in accordance with the present invention.

With further reference to the drawing, the invention includes a holder 10 which consists essentially of a substantially flat, modified hourglass shaped thin flexible body 11 preferably made of thermoplastic material. Such body has a first substantially straight end portion 12, tapering side walls 13 providing a narrowed waist portion, and a dome shaped end portion 14 at the opposite end.

The end portion 12 has a pair of inverted "J" shaped slits 15 and 16 extending inwardly from the end portion 12 in spaced relation to each other for retaining the ends of the strand of yarn or thread. The hook portion of the slits 15 and 16 face each other so as to more securely anchor the ends of the strand of yarn or other material.

Intermediate the waist portion and the end portion 14 a tongue member 20 is provided generally normal to the axis of the body 11. The tongue member has substantially parallel sides 21 spaced apart a predetermined distance and a curved free end 22. The opposite end 23 of the tongue defines a base which integrally connects the tongue to the body 11. The tongue is preferably punched or slit out of the sheet material of the body 11 in order that it may be displaced from the plane thereof or pressed back into the plane for the purpose of frictionally holding an identification member.

Adjacent to the dome shaped end portion 14, the body has an aperture 25 which is of a size for convenient reception of a ring or rod support member 26 as are commonly employed.

In the use of the device one end of an embroidery floss, thread or yarn Y of indetermine length is inserted into the "J" shaped slit 15 to anchor such end, after which such yarn extends across the body 11 and is wrapped around the waist portion of the body 11, and the opposite end of the yarn is inserted into the slit 16. The indicia bearing sleeve S which normally encircles the skein is removed therefrom and is slipped over the tongue 20 in order that the particular yarn which is wound on the body may be readily identified from the description on the sleeve.

After the sleeve S has been mounted on the tongue, such tongue may be depressed into the plane of the body 11 in order to frictionally engage the sleeve and assist in the retention of the same.

A substantial number of loaded bodies may be mounted on a single support member 26, or may be placed in a receptacle R, which is preferably transparent. As many boxes as may be required may be used and due to the configuration and arrangement, easy selection may be conveniently made.

We claim:

1. Apparatus for holding a flexible strand of yarn of indeterminate length, comprising a thin, substantially flat body of flexible thermoplastic material, said body including first and second end walls connected by side walls, said side walls tapering inwardly from said first and second end walls and defining a reduced waist about which a strand of yarn may be wound, said first end wall being substantially straight from side to side of said body and generally normal to the longitudinal axis thereof, a pair of oppositely facing substantially "J" shaped slits extending inwardly from said first end wall for receiving and frictionally retaining opposite ends of said yarn, each of said "J" shaped slits having a relatively straight portion and a hook portion, said straight portions being generally parallel to the longitudinal axis of said body, a tongue cut from said body between said reduced waist and said second end wall, said tongue having substantially parallel sides which are generally parallel to said first end portion and having a free end, the base of said tongue being integrally connected to said body so that a portion of said tongue may be displaced out of the plane of said body to removably receive an indicia bearing member, said portion of said tongue being repositionable in the plane of said body to assist in frictionally retaining said member thereon, and said body having an opening located adjacent to said second end wall for hanging said body from a support member.

2. The structure of claim 1 in which the hook portions of said "J" shaped slits are closer together than said straight portions.

3. The structure of claim 1 in which said second end wall is dome shaped.

* * * * *